US006951506B2

(12) United States Patent
Andideh et al.

(10) Patent No.: US 6,951,506 B2
(45) Date of Patent: Oct. 4, 2005

(54) POLISH PAD WITH NON-UNIFORM GROOVE DEPTH TO IMPROVE WAFER POLISH RATE UNIFORMITY

(75) Inventors: Ebrahim Andideh, Portland, OR (US); Matthew J. Prince, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/436,092

(22) Filed: Nov. 8, 1999

(65) Prior Publication Data

US 2001/0044263 A1 Nov. 22, 2001

Related U.S. Application Data

(62) Division of application No. 08/997,293, filed on Dec. 23, 1997, now Pat. No. 6,093,651.

(51) Int. Cl.[7] ..... B24B 1/00

(52) U.S. Cl. ..... 451/41; 451/526; 451/527; 451/528; 451/529; 451/530; 451/532

(58) Field of Search ..... 451/526, 527, 451/528, 529, 530, 532

(56) References Cited

U.S. PATENT DOCUMENTS 5,297,364 A 3/1994 Tuttle
5,645,469 A * 7/1997 Burke et al. ..... 451/41
5,665,249 A 9/1997 Burke et al.
5,730,642 A * 3/1998 Sandhu ..... 451/6
6,099,394 A * 8/2000 James et al. ..... 451/72
6,110,832 A * 8/2000 Morgan, III et al. ..... 438/692
6,824,455 B2 * 11/2004 Osterheld et al. ..... 451/285

* cited by examiner

*Primary Examiner*—Joseph J. Hail, III
*Assistant Examiner*—Shantese McDonald
(74) *Attorney, Agent, or Firm*—George Chen

(57) ABSTRACT

The present invention describes a method for creating a differential polish rate across a semiconductor wafer. The profile or topography of the semiconductor wafer is determined by locating the high points and low points of the wafer profile. The groove pattern of a polish pad is then adjusted to optimize the polish rate with respect to the particular wafer profile. By increasing the groove depth, width, and/or density of the groove pattern of the polish pad the polish rate may be increased in the areas that correspond to the high points of the wafer profile. By decreasing the groove depth, width, and/or density of the groove pattern of the polish pad the polish rate may be decreased in the areas that correspond to the low points of the wafer profile. A combination of these effects may be desirable in order to stabilize the polish rate across the wafer surface in order to improve the planarization of the polishing process.

5 Claims, 5 Drawing Sheets

(Fig. 1 PROFILE)

(Fig. 2 PROFILE)

(Fig. 3 PROFILE)

POLISH PAD WITH NON-UNIFORM GROOVE DEPTH TO IMPROVE WAFER POLISH RATE UNIFORMITY

This is a division of application Ser. No. 08/997,293, filed Dec. 23, 1997, now U.S. Pat. No. 6,093,651.

BACKGROUND OF THE INVENTION

1. Field of the Invention

The present invention relates to the field of semiconductor processing, and more specifically, to polishing methods and polishing pads for planarizing semiconductor materials in the fabrication of semiconductor devices.

2. Background Information

Semiconductor devices manufactured today generally rely upon an elaborate system of semiconductor device layers, patterns, and interconnects. The techniques for forming such various device layers, patterns, and interconnects are extremely sophisticated and are well understood by practitioners in the art. During fabrication, however, these varying device layers, patterns, and interconnects often create non-planar wafer topographies. Such non-planar wafer topographies cause difficulties when forming subsequent device layers, insulating layers, levels of interconnects, etc.

Some problems associated with non-planar topographies, for example, are the interference and scattering of radiation by the non-planar topography when performing photolithographic process steps. This makes it particularly difficult to print patterns with high resolution. Another problem with non-planar topographies is in depositing metal layers or lines. Uneven topographies, or step-heights as they are often called, may cause thinning of the metal line/layer at points where the topography transitions from a high point to a low point, and vice versa. Such thinning of the metal layers may cause open circuits to be formed in the device or may cause the device to suffer reliability problems.

To combat these problems, various techniques have been developed in an attempt to planarize the topography of the wafer surface prior to performing additional processing steps. One approach employs abrasive polishing, for example chemical mechanical polishing (CMP), to remove the high points along the upper surface. According to this method, the wafer is placed on a table and is polished with a pad that has been coated with an abrasive material (i.e. slurry). Both the wafer and the table are rotated relative to each other to remove the high portions of the wafer topography. This abrasive polishing process continues until the upper surface of the wafer is largely planarized.

One problem with polishing to planarize the topography is that the polishing rates can become unstable and/or uneven across the surface of the wafer. For example, the profile of the topography in certain areas of the wafer may affect the polishing rate in that area. FIG. 1 illustrates a simple example of the polishing rate profile of a wafer 100. As is illustrated in FIG. 1, the polishing rate at the edges 110 of wafer 100 is slower than the polishing rate toward the center 120 of wafer 100 (i.e., edge slow). The difference in polish rates across the wafer may cause the topography of the wafer to be uneven after polishing. For example, the polishing rate profile of FIG. 1 may cause the wafer topography to have low points in the center of the wafer and high points around the edges of the wafer, rather than a flat or planar surface as is desired.

It is desired to have an even polish rate profile across the wafer surface in order to improve the planarity of the polishing process. As illustrated in FIG. 1, an ideal polish rate profile is illustrated in FIG. 1 by dashed line 150. In order to arrive at the ideal polish rate profile 150, what is needed is method to increase the polish rate at the edges of the wafer 110, and decrease the polish rate at the center of the wafer 120. The ideal polish rate profile 150 will improve the surface planarity of the polishing process.

FIGS. 2 and 3 also illustrate examples wherein the polishing rates are uneven/unstable across the surface of a wafer. FIG. 2, illustrates the opposite effect of FIG. 1, wherein the polishing rate at the edges 210 of wafer 200 is faster than the polishing rate toward the center 220 of wafer 200 (i.e., center slow). Thus in FIG. 2, what is needed is a method to decrease the polish rate at the edges of the wafer 210, and increase the polish rate at the center of the wafer 220, in order to obtain the ideal polish rate profile 250. FIG. 3, illustrates a worst case scenario wherein the polishing rate varies randomly across the entire wafer surface. Thus in FIG. 3, what is needed is a method to decrease the polish rate in the areas of the wafer 300 where the polish rate is high, and increase the polish rate in the areas of the wafer 300 where the polish rate is low, in order to obtain the ideal polish rate profile 350.

Thus, what is needed is a method to increase the polish rate in the areas of a semiconductor wafer that the polish rate is low and/or decrease the polish rate in the areas of a semiconductor wafer that the polish rate is high in order to improve the planarization process of the semiconductor wafer.

SUMMARY OF THE INVENTION

The present invention describes a method for creating a differential polish rate across a semiconductor wafer. One embodiment of the present invention determines the profile of the semiconductor wafer by locating the high points and low points of the wafer profile. A grooved polish pad is provided and then the groove depth of the polish pad is adjusted by increasing the groove depth in the areas of the polish pad that correspond to the high points of said wafer profile. The semiconductor wafer is then polished with the polish pad.

Additional features and benefits of the present invention will become apparent from the detailed description, figures, and claims set forth below.

BRIEF DESCRIPTION OF THE DRAWINGS

The present invention is illustrated by way of example and not limitation in the accompanying figures in which.

DETAILED DESCRIPTION

A(n) Polish Pad With Non-Uniform Groove Depth To Improve Wafer Polish Rate Uniformity is disclosed. In the following description, numerous specific details are set forth such as specific materials, patterns, dimensions, etc. in order to provide a thorough understanding of the present invention. It will be obvious, however, to one skilled in the art that these specific details need not be employed to practice the present invention. In other instances, well known materials or methods have not been described in detail in order to avoid unnecessarily obscuring the present invention.

The present invention describes a method for improving the surface planarity during the fabrication of semiconductor device layers. The multi-layered structure of current semiconductor devices often leads to non-planar surfaces that can cause problems during the fabrication of subsequent device layers. One method developed to help solve the problem of non-planar wafer topographies is the use of chemical mechanical polishing (CMP) to planarize the wafer surface.

There are many factors that play a part in the planarization process. For chemical mechanical polishing, some of these factors include: the rotation rates of the polishing pad and wafer, the wafer topography or profile (i.e. the high points and low points on the wafer surface), the pressure with which the pad and wafer are put in contact, the material making up the polish pad, the slurry being used, the material being polished/planarized/removed, etc. All of these factors are important to the planarization process, however, even if all of these factors are optimized some planarization problems may still exist.

The present invention may be used singly or in combination with any of the above mentioned factors and optimization parameters to improve the planarization process. One embodiment of the present invention determines the profile or topography of the wafer. In other words, it is determined where the high points and low points are on the wafer surface. It should be obvious to one with ordinary skill in the art that well know methods for determining wafer topography may be used and are therefore not discussed in detail herein.

Figure 4A:
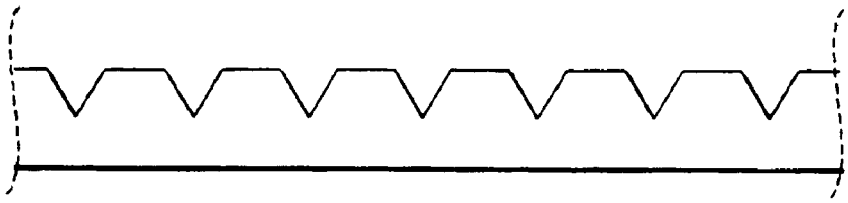
FIG. 4*a* illustrates a cross-sectional view of a polish pad having v-shaped grooves.
Figure 4B:
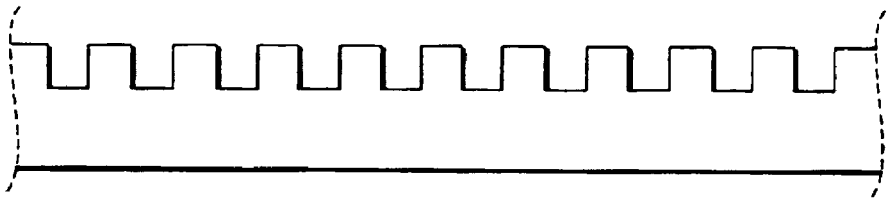
FIG. 4*b* illustrates a cross-sectional view of a polish pad having u-shaped grooves.
Figure 4C:
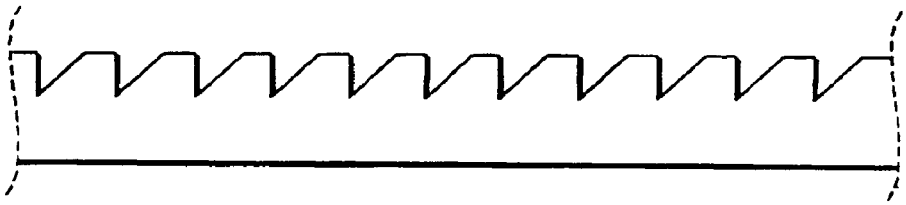
FIG. 4*c* illustrates a cross-sectional view of a polish pad having one-sided triangle grooves.

Typically, a polish pad will contain grooves such as those illustrated in FIGS. 4*a–c*. FIG. 4*a* illustrates a polish pad having v-shape grooves therein. FIG. 4*b* illustrates a polish pad having u-shape grooves therein. FIG. 4*c* illustrates a polish pad having single-sided triangle grooves therein. Although, FIGS. 4*a–c* illustrate only a single shape of groove per polish pad, it should be noted that different groove shapes and/or a combination of groove shapes may be used on a polish pad.

Generally, the grooves are cut into the polish pad during manufacture of the polish pad and are usually uniformly spaced across the diameter of the polish pad. Additionally, the groove depth and groove width are uniform across the polish pad surface. However, such uniform groove density, groove width, and groove depth may cause non-uniform polish rates across the wafer surface such as those illustrated in FIGS. 1–3, edge slow, center slow, and random, respectively.

The present invention improves the planarization process by adjusting and/or changing the grooves which are in the polishing pad. Groove shape, groove depth, groove width, and groove density all play a part in the planarization process. Changing the groove shape, groove depth, groove width, and/or groove density, either singly or in combination, can affect the polishing rate of the wafer. As such, changing the groove shape, groove depth, groove width, and/or groove density, either singly or in combination, also affects the polish rate profile of the wafer.

By changing the grooves in the areas of the polish pad that correspond to the areas of the wafer where the high points and low points of the wafer topography and/or the areas where the polish rate profile is either high or low, the polish rate may be stabilized. Stabilizing the polish rate will in turn improve planarization. By increasing the groove depth, width, and/or density the polish rate is increased which will more effectively remove the high points in the wafer topography and/or stabilize the polish rate in areas of the wafer where the polish rate would have been too low. For example in FIG. 1 that illustrates edge slow, the groove depth, width, and/or density would be increased in the areas of the polish pad that correspond to the edges of the semiconductor wafer in order to increase the polish rate so that the desirable polish profile 150 may be achieved.

By decreasing the groove depth, width, and/or density the polish rate is decreased which will remove less of the topography near the low points and/or stabilize the polish rate in areas of the wafer where the polish rate would have been too high and otherwise would have removed too much of the topography. For example, in FIG. 2 that illustrates center slow, the groove depth, width, and/or density would be decreased in the areas of the polish pad that correspond to the center of the semiconductor wafer in order to decrease the polish rate at the center of the wafer so that the desirable polish profile 250 may be achieved. Similar adjustments may be made in FIG. 3 that illustrates a random wafer profile in order to achieve the desirable polish rate profile 350.

It should be noted and it will be obvious to one with ordinary skill in the art given this description that the grooves may be changed in any number of combinations. For example, in FIG. 1 that illustrates edge slow, the groove depth, width, and/or density may be increased at the edges of the wafer and may be decreased at the center of the wafer. Depending upon the result desired by the user, just the groove depth, or just the groove width, or just the groove density may be increased or decreased in some areas. The user may also determine that it would be more beneficial to adjust groove depth and groove width, or groove depth and groove density, or groove width and groove density, or all three: groove depth, width, and density in some areas to obtain the desired result. Thus, the grooves may be adjusted in many various combinations in order to achieve the optimum polish rate profile desired by a particular user.

Figure 1:
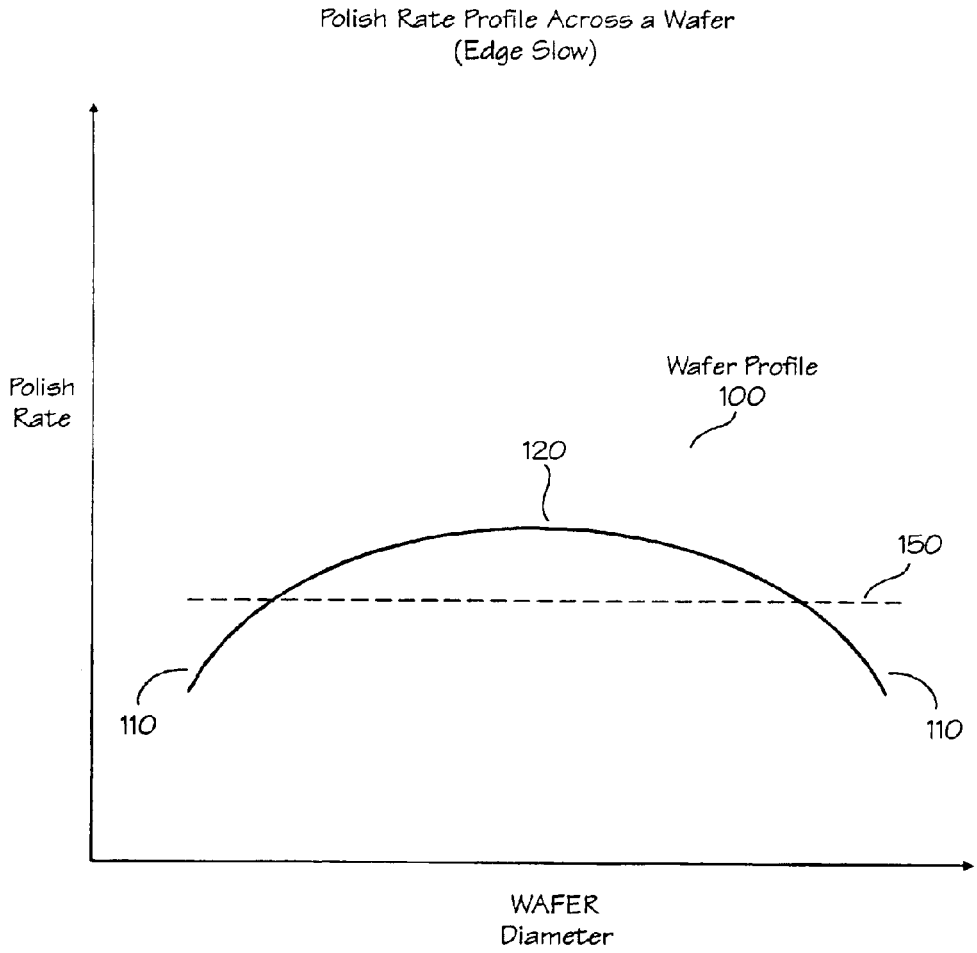
FIG. 1 illustrates an edge slow polish rate profile of a semiconductor wafer.
Figure 5A:
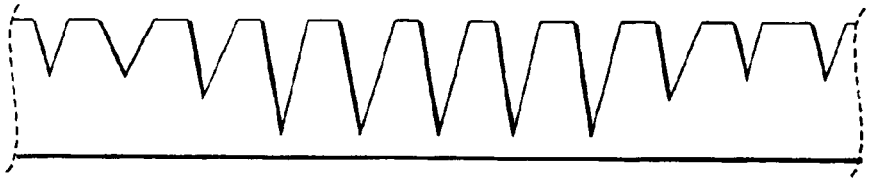
FIG. 5*a* illustrates a cross-sectional view of a polish pad having v-shaped grooves according to one embodiment of the present invention and the polish rate profile of FIG. 1.
Figure 5B:
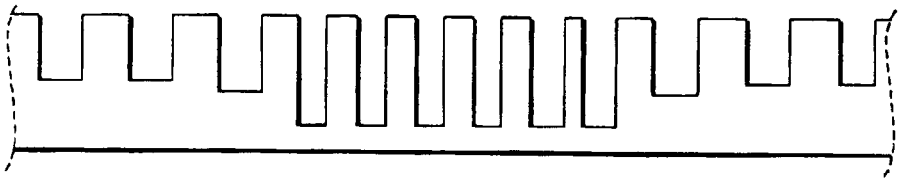
FIG. 5*b* illustrates a cross-sectional view of a polish pad having u-shaped grooves according to another embodiment of the present invention and the polish rate profile of FIG. 1.

FIG. 5*a* illustrates a cross-sectional view of a polish pad having v-shaped grooves according to one embodiment of the present invention and the polish rate profile of FIG. 1. In order to achieve the desired polish rate profile 150 the groove width and groove depth of the grooves in the center of the polish pad of FIG. 5*a* are increased in order to increase the polish rate at the center of the wafer. FIG. 5*b* illustrates a cross-sectional view of a polish pad having u-shaped grooves according to another embodiment of the present invention and the polish rate profile of FIG. 1. Similar to FIG. 5*a*, the grooves of the polish pad in FIG. 5*b* increase in depth and density in order to increase the polish rate at the center of the wafer. The polish pads of FIGS. 5*a* and 5*b* correspond to a wafer profile wherein the wafer has low points at the edge of the wafer and high points at the center of the wafer. Thus, where the wafer profile has high points in the center of the wafer and the polish rate would ordinarily be slow the present invention increases the groove depth, width, and/or density in order to increase the polish rate and remove the high points of the topography to achieve the desired wafer profile 150.

Figure 2:
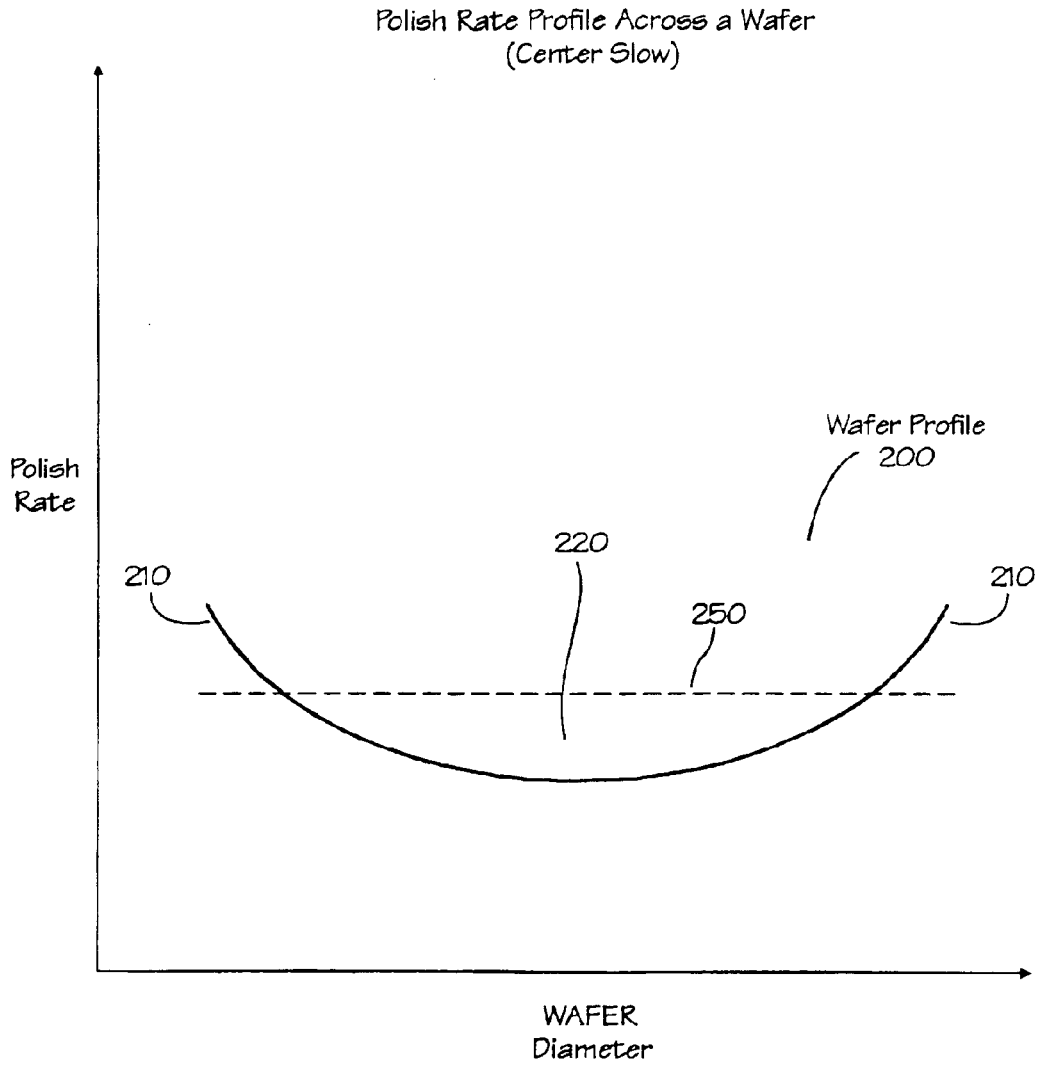
FIG. 2 illustrates a center slow polish rate profile of a semiconductor wafer.
Figure 6:
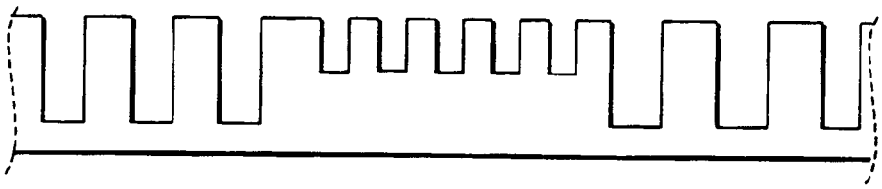
FIG. 6 illustrates a cross-sectional view of a polish pad having u-shaped grooves according to still another embodiment of the present invention and the polish rate profile of FIG. 2.

FIG. 6 illustrates a cross-sectional view of a polish pad having u-shaped grooves according to still another embodiment of the present invention and the polish rate profile of FIG. 2. The polish pad of FIG. 6 corresponds to a wafer profile wherein the wafer has high points at the edge of the wafer and low points at the center of the wafer. As illustrated in FIG. 6 the depth and width of the grooves at the edges are increased in order to increase the polish rate at the edges of the wafer. Also, as illustrated in FIG. 6 the depth and width of the grooves at the center of the polish pad are decreased in order to reduce (or decrease) the polish rate at the center of the wafer. Thus, the polish pad of FIG. 6 may be used to increase the polish rate at the edge of the wafer and decrease the polish rate in the center of the wafer in order to achieve the desired polish rate profile 250 illustrated in FIG. 2.

Figure 3:
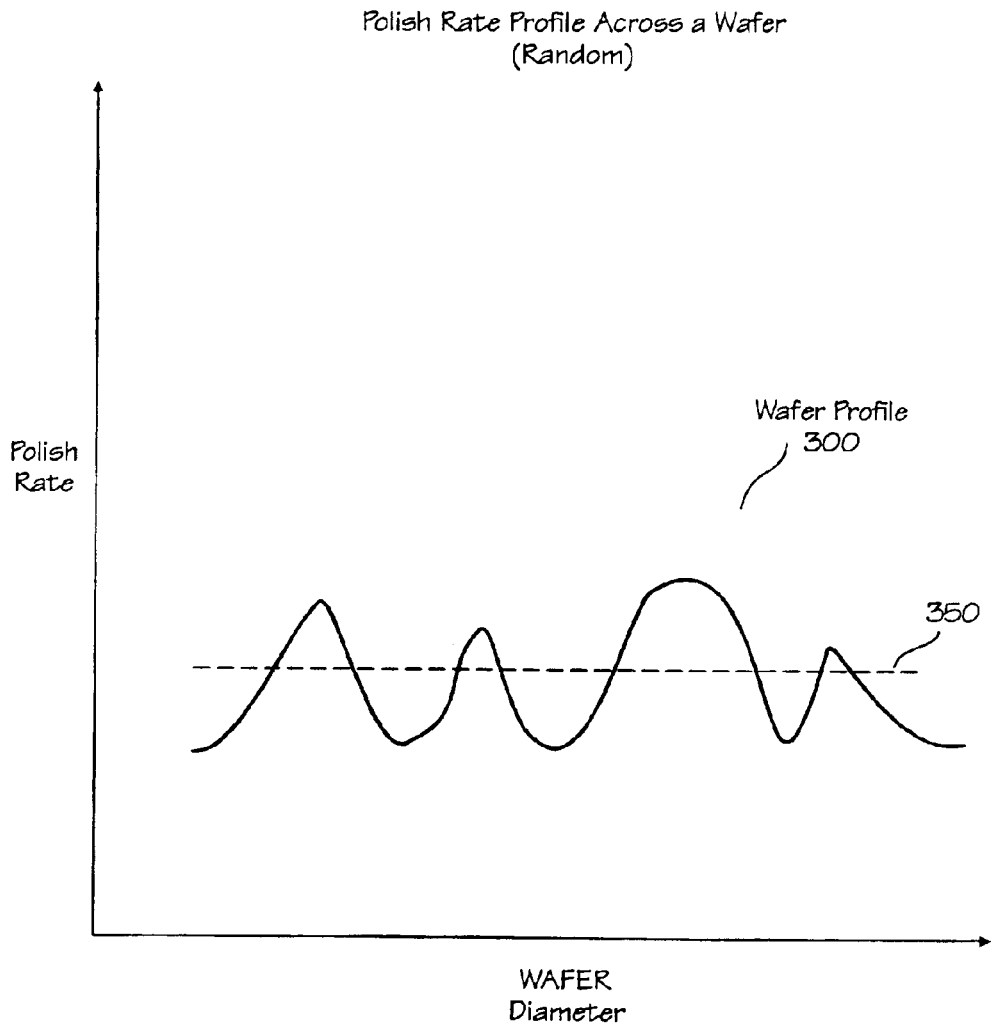
FIG. 3 illustrates a random polish rate profile of a semiconductor wafer.
Figure 7:
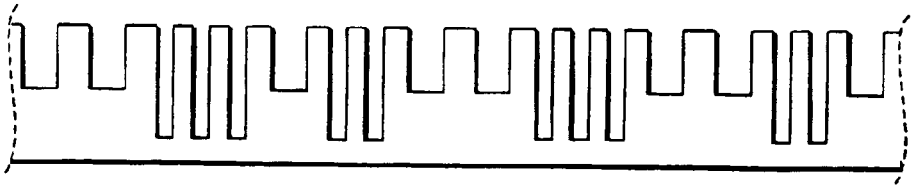
FIG. 7 illustrates a cross-sectional view of a polish pad having u-shaped grooves according to yet another embodiment of the present invention and the polish rate profile of FIG. 3.

FIG. 7 illustrates a cross-sectional view of a polish pad having u-shaped grooves according to yet another embodiment of the present invention and the polish rate profile of FIG. 3. The polish pad of FIG. 7 corresponds to a wafer profile wherein the wafer has random high points and low points. As illustrated in FIG. 7 the depth, width, and density of the grooves are increased in the areas of the polish pad corresponding to high points of the wafer profile in FIG. 3. Also, as illustrated in FIG. 7 the depth, width, and density of the grooves are decreased in the areas of the polish pad corresponding to low points of the wafer profile in FIG. 3. Thus, the polish pad of FIG. 7 may be used to increase the polish rate in areas of the wafer wherein the high points would otherwise cause the polish rate to be low and decrease the polish rate in areas of the wafer wherein the low points would otherwise cause the polish rate to be too high in order to achieve the desired polish rate profile 350 illustrated in FIG. 3.

It should be noted that the grooves of the polish pad should be adjusted while keeping in mind the parameters of the particular polish pad so not to degrade the usefulness of the polish pad. For example, the depth of the grooves should not be increase to the point where the polish pad becomes weak or brittle. As another example, the width of the grooves should not be increased to be so large as not to be effective or cover too large an area on the polish pad. Likewise, the density of the grooves should not be increased beyond the point where the portions of the polish pad that separate the grooves are too thin or brittle and may break.

In one embodiment of the present invention the groove depth is adjusted within the range of approximately 1–90% of the pad thickness. In another embodiment of the present invention the groove width is adjusted within the range of approximately 1–100 mils. In yet another embodiment of the present invention the groove density is adjusted within the range of approximately 2–50 grooves/inch. It will be obvious to one with ordinary skill in the art that such parameters may be dependent upon the strength, durability, surface area, pad thickness, material, and etc. that make up the polish pad.

It should be noted that deeper and/or wider and/or more dense grooves improve slurry transport and distributes more slurry to the areas where a higher polish rate is desired. It should also be noted that wider grooves and/or more dense grooves increase the pressure in the areas where a higher polish rate is desired. By changing the groove depth, width, and/or density the present invention distributes more slurry and/or increases the pressure of the polish pad in the areas where a higher polishing rate is desired in order to achieve the desired polish profiles, for example, polish profiles 150, 25Q, and 350 illustrated in FIGS. 1, 2, and 3, respectively.

Thus, Polish Pad With Non-Uniform Groove Depth To Improve Wafer Polish Rate Uniformity has been described. Although specific embodiments, including specific equipment, patterns, methods, and materials have been described, various modifications to the disclosed embodiments will be apparent to one of ordinary skill in the art upon reading this disclosure. Therefore, it is to be understood that such embodiments are merely illustrative of and not restrictive on the broad invention and that this invention is not limited to the specific embodiments shown and described.

What is claimed is:

1. A polish pad comprising:

a first set of grooves disposed in a first area, said first set of grooves having a first depth; and a second set of grooves disposed in a second area, said second set of grooves having a second depth, wherein said first set of grooves does not intersect said second set of grooves and wherein said first depth is smaller than said second depth to reduce polish rate in said first area.

2. The polish pad of claim 1 wherein said first area corresponds to a center of a wafer to be polished on said polish pad.

3. The polish pad of claim 1 wherein said first area corresponds to edges of a wafer to be polished on said polish pad.

4. The polish pad of claim 1 wherein said first area is disposed in a center of said polish pad.

5. The polish pad of claim 1 wherein said first area is disposed at edges of said polish pad.

* * * * *